US007507071B2

(12) United States Patent
Kopmels et al.

(10) Patent No.: US 7,507,071 B2
(45) Date of Patent: Mar. 24, 2009

(54) COOLING ARRANGEMENT

(75) Inventors: Michiel Kopmels, Bristol (GB); Michael Jago, Bristol (GB); Keith Sadler, Bristol (GB); Peter Goodman, Bristol (GB)

(73) Assignee: Rolls-Royce PLC, London (GB)

( * ) Notice: Subject to any disclaimer, the term of this patent is extended or adjusted under 35 U.S.C. 154(b) by 455 days.

(21) Appl. No.: 11/262,754

(22) Filed: Nov. 1, 2005

(65) Prior Publication Data

US 2006/0140763 A1 Jun. 29, 2006

(30) Foreign Application Priority Data

Nov. 9, 2004 (GB) ..... 0424668.2
Oct. 12, 2005 (GB) ..... 0520695.8

(51) Int. Cl.
*F01D 5/08* (2006.01)
*F01D 5/18* (2006.01)

(52) U.S. Cl. ..... 416/96 R; 415/115; 416/96 A; 416/97 R

(58) Field of Classification Search ..... 415/115; 416/96 R, 96 A, 97 R
See application file for complete search history.

(56) References Cited

U.S. PATENT DOCUMENTS 4,820,123 A * 4/1989 Hall ..... 416/97 R
5,387,086 A * 2/1995 Frey et al. ..... 416/97 R
5,403,159 A * 4/1995 Green et al. ..... 416/97 R
5,462,405 A * 10/1995 Hoff et al. ..... 416/97 R
5,472,316 A * 12/1995 Taslim et al. ..... 416/97 R
5,743,708 A * 4/1998 Cunha et al. ..... 415/115
5,813,836 A 9/1998 Starkweather
5,857,837 A * 1/1999 Zelesky et al. ..... 416/97 R
5,975,850 A * 11/1999 Abuaf et al. ..... 416/97 R
5,993,156 A * 11/1999 Bailly et al. ..... 416/96 A
6,139,269 A * 10/2000 Liang ..... 416/97 R
6,491,496 B2 * 12/2002 Starkweather ..... 416/97 R
6,561,758 B2 * 5/2003 Rinck et al. ..... 415/115
6,840,737 B2 * 1/2005 Flatman ..... 415/116
2004/0202542 A1 * 10/2004 Cunha et al. ..... 416/97 R

FOREIGN PATENT DOCUMENTS

EP 1 219 784 A2 7/2002
EP 1384855 A2 1/2004
EP 1 420 142 A1 5/2004

(Continued)

*Primary Examiner*—Igor Kershteyn
(74) *Attorney, Agent, or Firm*—Oliff & Berridge, PLC

(57) ABSTRACT

A cooling arrangement is provided in which an incident coolant flow is presented to a passage such that a proportion of that flow is diverted in order to create a standing relative overpressure in a chamber compared to the actual static pressure of the flow in the passage. In such circumstances through flow transfer apertures in the walls of the chamber forced coolant flows are presented for impingement upon surfaces and therefore greater heat transfer. Generally, coolant flow is presented to both ends of the chamber in order to create the relative standing overpressure in the chamber relative to the current static pressure presented in the passage through the incident flow. In such circumstances through utilizing the dynamic rotation or other motion of a component incorporating the arrangement a higher relative pressure is achieved for greater force coolant flow projection compared to the incident or actual static pressure of the incident coolant flow in the.

13 Claims, 3 Drawing Sheets

FOREIGN PATENT DOCUMENTS

| | | | |
|---|---|---|---|
| GB | 783177 | A | 9/1957 |
| GB | 1322801 | A | 7/1973 |
| GB | 1332679 | A | 10/1973 |
| GB | 1351028 | A | 4/1974 |
| GB | 1605191 | A | 3/1983 |
| GB | 2189553 | A | 10/1987 |

* cited by examiner

COOLING ARRANGEMENT

BACKGROUND

The present invention relates to cooling arrangements and more particularly to cooling arrangements used in dynamic components such as turbine blades in a turbine engine.

SUMMARY

It will be appreciated that engine efficiency with respect to turbine engines is highly dependent upon operational temperature. Unfortunately, there are physical limitations upon the abilities of the materials from which critical components are formed. In such circumstances cooling of those components is highly important and may allow operational temperatures for the engine which approach or even exceed the melting temperatures for materials from which components in the engine are formed.

Typically, coolant air flow is taken from the compressor stages of an engine and appropriately presented in the turbine stages of that engine. It will be appreciated that achieving relatively high cooling efficiency through heat transfer to the coolant flow is desirable, which may be achieved using impingement techniques. In such circumstances coolant air flow impingement and direction should be achieved by utilising relatively simple structures in order to avoid additional component fabrication complexity and possibly additional weight.

The present invention particularly relates to dynamic components such as turbine blades within an engine. It will be understood by their nature these blades have a relatively confined cross-section which limits the possibility for flow control. In such circumstances previously cooling has been achieved through coolant flow ejection to form a film coolant about the blade surface and through internal passage heat transfer.

In accordance with the present invention there is provided a cooling arrangement for a component of an engine, the arrangement comprising a passage for presenting a coolant flow to a component whereby one end of the passage is provided with coolant flow inlet means and the passage comprises a chamber having coolant flow inlets at either end and flow transfer apertures provided in the wall(s) defining the chamber, the chamber configured to receive coolant flow at the flow inlets whereby in use a dynamic component of the flow in the chamber is lower than that of the passage, resulting in a corresponding increase in static pressure, so that the coolant is able to flow through the flow transfer apertures.

Preferably, the coolant flow exiting the flow transfer apertures impinges upon a surface of a component in use to facilitate cooling of that component.

Typically, the transfer apertures are presented laterally outward from the chamber.

Possibly, the coolant flow inlet presents chamber coolant flow at both ends of the chamber. Possibly, the passage has a single inlet flow means at one end of the passage.

Possibly, the chamber is positioned within the passage.

Possibly, the chamber incorporates a bifurcated entrance.

Possibly, the chamber is formed by one or more other passages.

Possibly, there are a plurality of chambers within the passage.

Typically, the flow transfer apertures may have a different distribution along the length of the chamber in order to facilitate force directed coolant flow through those flow transfer apertures.

Possibly, the chamber is configured to achieve a desirable static pressure variation with blade height. Preferably the chamber cross-sectional area varies in the flow direction in order to achieve a desirable distribution of static pressure along the chamber.

Also in accordance with the present invention there is provided a turbine blade incorporating a cooling arrangement as described above. Additionally, the present invention includes an engine incorporating a turbine blade as described previously.

BRIEF DESCRIPTION OF THE DRAWINGS

An embodiment of the present invention will now be described by way of example and with reference to the accompanying drawings in which.

DETAILED DESCRIPTION OF EMBODIMENTS

Figure 1:
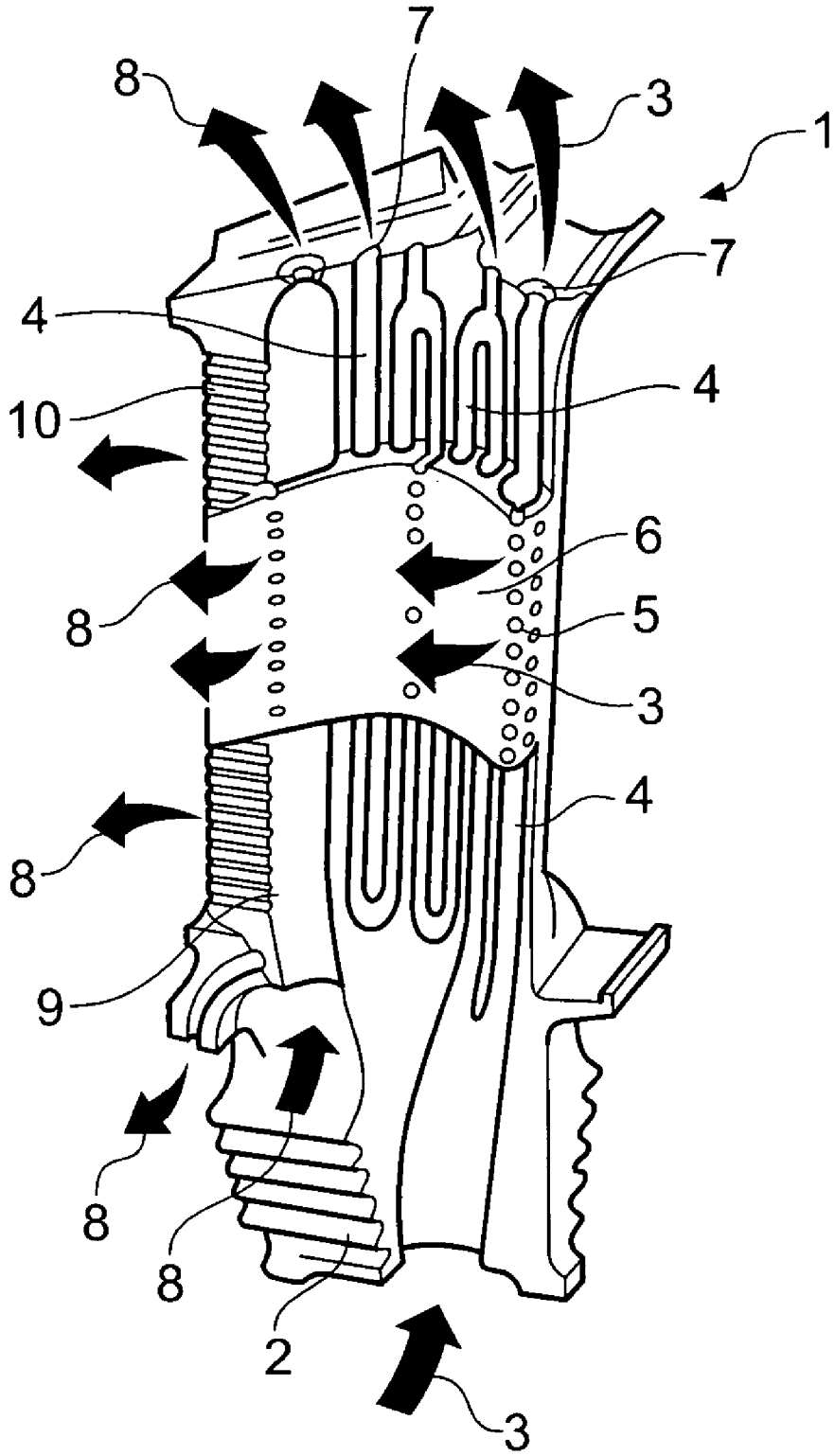
FIG. 1 is a schematic part cut-away of a typical prior multi-pass cooling arrangement in a turbine blade.

Referring to FIG. 1 showing in part cut-away a typical existing turbine blade 1. Thus, the blade 1 includes a fir tree root mounting 2 by which the blade 1 is secured to a rotating disc (not shown) to form a turbine stage in a turbine engine. Coolant air flow is presented to the blade 1 in order to provide cooling to that blade 1 for reasons as described previously. The coolant flow is presented in a relatively high pressure flow 3 which passes through pathways 4 in the blade 1 in order to provide cooling. The coolant flow through the pathways 4 also is ejected through apertures 5 upon the blade surface 6 in order to develop a coolant film on that surface 6 as well as through end apertures 7 at the tip of the blade 1. A second relatively low pressure coolant air flow 8 generally passes through a gap between the mounting root 2 and the rotor disc for the turbine. This flow again enters a cavity 9 in order to cool tail portions of the blade 1. The coolant flow may again exit apertures in the surface 6 and also pass through lateral slots 10 in the blade 1. In these circumstances cooling of the blade 1 is achieved.

It will be understood from the typical turbine blade 1 depicted in FIG. 1 that coolant air flow 7, 8 are generally along the passages within which they flow. Previously, in order to improve heat transfer the passage surfaces have incorporated dimples or ribs or other features in order to enhance.

Figure 2:
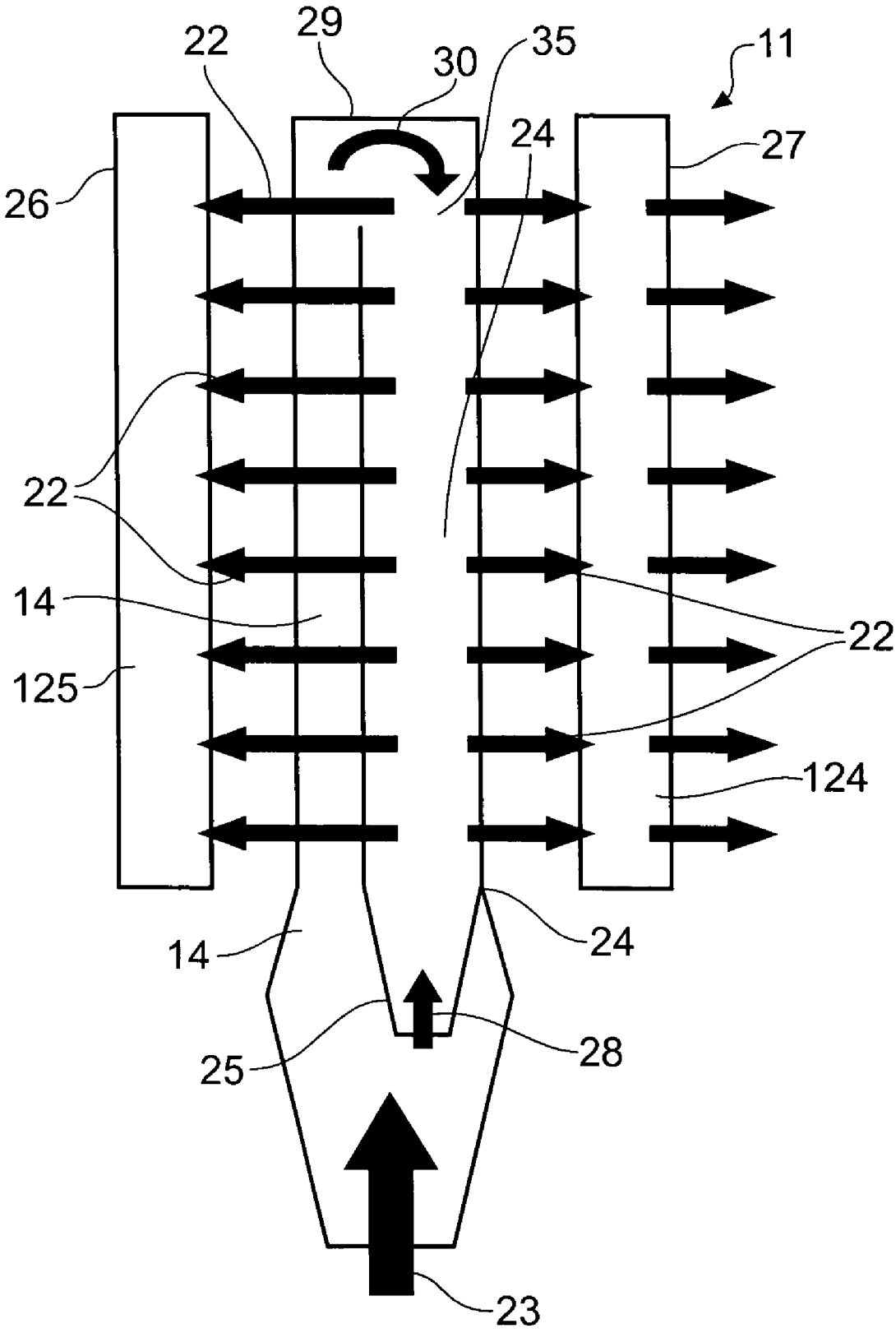
FIG. 2 is a schematic cross-section of a cooling arrangement in accordance with the present invention.

It will be understood that impingement of air flows upon a surface, that is to say the striking of an airflow jet upon a surface, significantly improves heat transfer from that surface. Thus, as depicted in FIG. 2 with respect to a schematic cross-section of a cooling arrangement 11 in accordance with the present invention, a passage 14 incorporates a chamber 24 such that an air flow 23 is directed into the chamber 24 in the direction of arrowhead 28. In the embodiment depicted a bifurcated inlet entry end 25 is provided in order to take a proportion of the coolant air flow 23 whilst another inlet end 35 has a flow 30 through it. Thus, there is increased static pressure to force outward flow through apertures in the chamber 24 wall towards downstream passages 124, 125. Such over pressure in the chamber 24 directs coolant air flow in the direction of arrowheads 22 upon surfaces 26, 27 typically as described above which form part of a turbine blade or other dynamic component. A proportion of the air flows 22 may then pass through apertures (not shown) onto the surface 27 as described previously in order to develop a coolant film barrier consistent with respect to previous turbine blade cooling arrangements. A proportion of the air flows 22 may then pass through to further passages (126) or components possible using further impingement. Typically, said surfaces would be hot outer surfaces such as Leading Edge (LE), Trailing Edge (TE), Pressure Surface (PS) and Suction Surface (SS).

It is by configuration of the chamber 24 that the relative "over pressure" is achieved. As indicated above in the embodiment depicted in FIG. 2, coolant flow inlet means is provided for the passage 14 in the form of a single main inlet such that through a bi-furcated entry end 25, a flow 28 is diverted from that flow 23 in order to create the relative "over pressure" in the chamber 24 by opposing flow 30, thereby reducing its dynamic component of pressure. Alternatively, there may be provided more than one inlet for each passage 14 or through appropriate alternatives airflow may enter the chamber 24 without the necessity for a bifurcated end 28 effectively scooping airflow into the chamber 24. In any event it is by establishing a settled or stable "over pressure" within the chamber 24 through opposed flows that the lateral projection of the impinging force directed airflows 22 is achieved through a flow transfer surface including flow projection apertures.

In the embodiment depicted in FIG. 2, airflow enters the chamber 24 from both ends, flows 28, 30. Thus, airflow is diverted as described above through the bifurcated end 25 and also through provision of a closure 29 bypassed airflow 30 is diverted into the chamber 24. In such circumstances it will be appreciated that the returned airflow 30 opposes the flow 28 in order to create the "over pressure" with the chamber 24 and subsequent lateral projection of the impinging airflows 22 against surfaces 26, 27. The present cooling arrangement essentially comprises one or more chamber 24 having a transfer of coolant air flow 23 between that chamber 24 and an adjacent chamber formed by the remainder of the passage 14 such that through a relative standing overpressure, air flow is forced through flow transfer apertures in the chamber 24 surface in order to cause directed impingement upon surfaces 26, 27 to be cooled. Such impingement as indicated will greatly enhance heat transfer and therefore efficiency with respect to the coolant flows through the arrangement.

Once the necessary configuration for a standing relative overpressure is created within the chamber 24 it will be appreciated that the flow transfer apertures in the chamber walls may be arranged for most judicious operation. Thus, the apertures may be arranged to create as indicated in FIG. 2 substantially uniform lateral force directed presentation to the surfaces 26, 27. Alternatively, the apertures may be angled or distributed to create the desired impingement airflows upon the surfaces 26, 27 for most appropriate operation.

The present invention as indicated relates to dynamic components such as turbine blades and so in use centrifugal forces presented within those blades may also be utilised in order to create and maintain the relative standing overpressure between the chamber 24 and the passage 14. Again, the size and distribution of the apertures may be varied through the length and breadth of the cavity 24 wall surface in order to achieve the most effective operational standing overpressure to force coolant flow protection towards the surfaces 26, 27.

The embodiment of the present invention depicted in FIG. 2 as indicated is schematic. Thus, it will be appreciated that in practical embodiments more passages and/or chambers may be provided in order to achieve the desired standing overpressure to force flow projection, typically laterally towards surfaces to be cooled.

It will be understood that it is typically the direct or high pressure coolant flow (flow 3 in FIG. 1) which is utilised in the present invention in order to create the lateral impinging forced coolant flows through the flow transfer wall surfaces of the chamber. High incident pressure provides greater scope for configurational variations/differentiations between the flow passage and cavity in order to create the standing overpressure for lateral forced impingement coolant flows upon surfaces.

Although illustrated with respect to a turbine blade, it will be understood that other dynamic components could incorporate a cooling arrangement in accordance with the present invention. Furthermore the cooling arrangement could be utilised with regard to stator vanes or liner components in a turbine engine in which advantageously a high pressure coolant flow is utilised to create the desired standing pressure differential, whereby there can be forced coolant flow impingement upon surfaces to be cooled. As indicated within a turbine engine, typically the coolant flow is taken from the compressor or fan stages of that engine and through appropriate passage trunking. This coolant flow is presented to the hot turbine or post combustor parts of that engine for cooling.

As indicated above, it is by creating the standing in use pressure differential between the chamber and passage that force diverted coolant flow projection is achieved for cooling of impinged surfaces. In such circumstances the position of the bi-furcated end or dynamic pressure component can be adjusted to be at a point along the passage 14 in order to control the flow 23 split at the end 25, and so the achieved standing flow pressure differential. It will also be understood that by appropriate entry and positioning the amount of coolant flow 23 essentially "tapped off" from the incident flow can be adjusted.

In terms of fabrication it will be appreciated that the chamber 24 may be positioned at the centre of a blade or along an external part of that blade as required for operational performance. For comparison with prior arrangements it will be appreciated that presentation of relatively high pressures in the incident flow with a closed end to the passage will cause lateral projection of coolant flow out of the surface apertures. In such circumstances, the static pressure of the incident flow is determinant as to the forced projection rate. Nevertheless, it will be appreciated that the static pressure driving the impingement flows in such prior systems is significantly less than the total pressure. In previous arrangements the heat transfer level achieved by impingement is as indicated governed by the static pressure in the supply chamber or passage. In short, the higher the pressure the higher the impingement forced flow.

Thus, more focused flows ensure that the cooling effects are maximised for a particular flow rate and the extent of the inherent parasitic effect of coolant flow removal, which can lead to reduced engine efficiency and performance is diminished.

The present invention utilises by creation of a standing overpressure in a chamber these additional features of dynamic components in order that some of the dynamic pressure is recovered by slowing down the coolant flow such that there is a greater driving pressure through the flow transfer apertures, and therefore greater relative impingement forced flows upon the surfaces. In such circumstances greater impingement effect is achieved for given inlet pressure with the possibility of either reducing the inlet pressure required to achieve the desired cooling effect or providing improved cooling within a turbine engine at a given inlet pressure.

Figure 3:
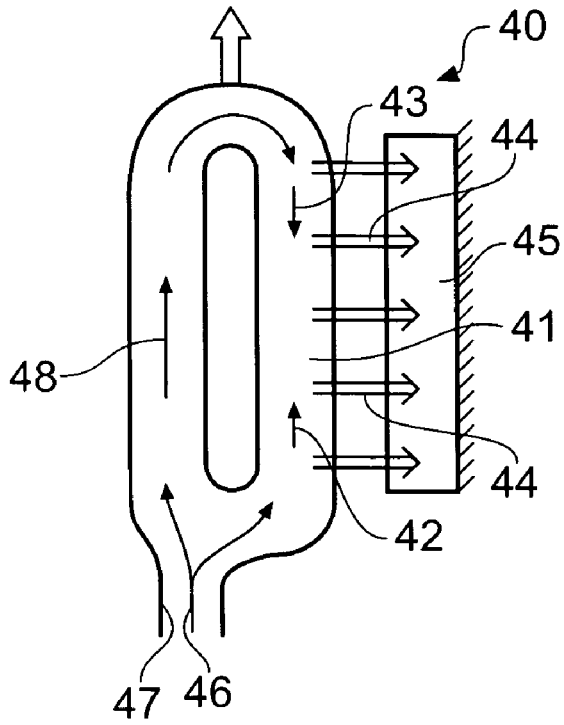
FIG. 3 is a schematic illustration of a first alternative cooling arrangement in accordance with the present invention.
Figure 4:
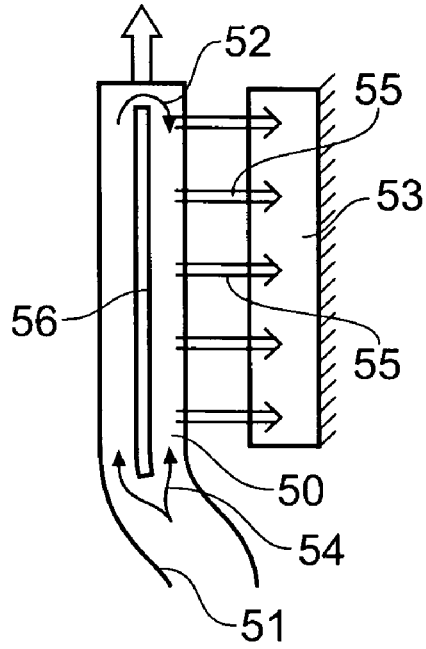
FIG. 4 is a schematic illustration of a second alternative cooling arrangement in accordance with the present invention.

By creation of an increased static pressure a driving force is provided to improve impingement upon a target for cooling purposes. FIG. 3 illustrates a first alternative embodiment of a cooling arrangement in which a separate passage defines a pseudo chamber in which opposed flows create a static pressure for impingement projection of coolant towards a target. Thus, in a primary dynamic flow passage, coolant flow is generally in one direction depicted by arrowhead whilst in the separate passage defining the pseudo chamber in accordance with the present invention, flows in the direction of arrowheads, oppose each other to increase static pressure and therefore impingement projection in the direction of arrowheads towards the target. Similarly, in FIG. 4 an integral chamber may be formed within a passage in order to improve the static pressure for projection towards a target. Thus, the integral chamber will be formed within a passage to create the opposed flows and therefore improve static pressure for impingement. By provision of an effectively solid divider in the passage or chamber, it will be understood that opposed flows are created which are then utilised in order to improve the static pressure and therefore projection for impingement upon the target through the apertures in the passage wall.

Figure 5:
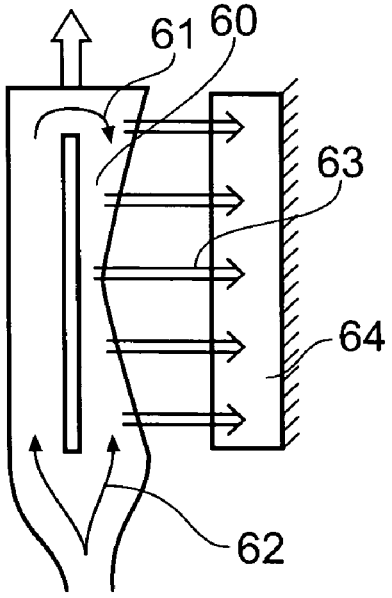
FIG. 5 is a schematic illustration of a shape configuration to improve particularly operation of the alternative cooling arrangements depicted in FIG. 3 and FIG. 4.

In order to improve static pressure profile it will be seen in FIG. 5 that the shape of the passage or chamber can be altered in order to vary the cross-section and therefore constriction of the opposed flows whereby the projection flows towards the target through the apertures can be regularised along the length of the chamber or passage defining a pseudo chamber in accordance with the present invention for increased static pressure.

The invention claimed is:

1. A cooling arrangement for a component of an engine, the arrangement comprising:

a passage for presenting a coolant flow to the component whereby the passage is provided with a single flow inlet at one end and the passage comprises a chamber having coolant flow inlets at opposed ends and flow transfer apertures provided in the walls defining the chamber, said apertures being in flow communication with a downstream passage, the chamber being configured to receive coolant flow at each of the flow inlets such that flow from one inlet is in opposition to flow from the opposing inlet, thereby resulting in sufficient static pressure in the chamber so that the coolant is able to flow through the flow transfer apertures and impinge upon a surface of the downstream passage.

2. An arrangement as claimed in claim 1 wherein the transfer apertures are presented laterally outward from the chamber.

3. An arrangement as claimed in claim 1 wherein the chamber coolant flow inlet presents coolant flow at both ends of the chamber.

4. An arrangement as claimed in claim 1 wherein the chamber is positioned within the passage.

5. An arrangement as claimed in claim 1 wherein the chamber is formed by one or more other passages.

6. An arrangement as claimed in claim 1 wherein the passage flow inlet incorporates a bi-furcated entrance.

7. An arrangement as claimed in claim 1 wherein there are a plurality of chambers within the passage.

8. An arrangement as claimed in claim 1 wherein the flow transfer apertures are distributed along the length of the chamber such that they provide forced directed coolant flow through said flow transfer apertures.

9. An arrangement as claimed in claim 8 wherein the chamber cross-sectional area varies in the flow direction in order to achieve a desirable distribution of static pressure along the chamber.

10. An arrangement as claimed in claim 1 wherein the component is a static component.

11. A cooling arrangement as claimed in claim 1 wherein the component is a dynamic component of a turbine engine.

12. A cooling arrangement as claimed in claim 1 wherein the component is a turbine blade.

13. A turbine engine incorporating a turbine blade as claimed in claim 12.

* * * * *